United States Patent [19]

Wanger

[11] 4,009,316

[45] Feb. 22, 1977

[54] SOIL HIDING, SOIL RESISTANT FIBER COMPRISING A RELATIVELY MAJOR AMOUNT OF A POLYAMIDE COMPONENT AND A MINOR AMOUNT OF AN ACRYLATE POLYMER COMPONENT

[75] Inventor: W. Hunter Wanger, Southhampton, Pa.

[73] Assignee: Rohm and Haas Company, Philadelphia, Pa.

[22] Filed: Dec. 4, 1972

[21] Appl. No.: 312,156

Related U.S. Application Data

[63] Continuation-in-part of Ser. No. 242,822, April 10, 1972, abandoned.

[52] U.S. Cl. ..... 428/364; 260/857 UN; 264/210 F; 264/DIG. 26; 428/374; 428/400

[51] Int. Cl.[2] ..... B32B 27/02; C08L 77/00; D01D 5/12; D02G 3/00

[58] Field of Search ..... 260/857 PE, 857 UN, 260/857 D; 264/210 F, DIG. 26; 161/178, 180; 428/364, 374, 400

[56] References Cited

UNITED STATES PATENTS

| | | | |
|---|---|---|---|
| 2,710,853 | 6/1955 | Edwards et al. | 260/78 T |
| 3,322,611 | 5/1967 | Stevenson | 161/178 |
| 3,474,050 | 10/1969 | Chappelear et al. | 260/857 UN |
| 3,480,569 | 11/1969 | Chappelear et al. | 260/857 UN |
| 3,546,063 | 12/1970 | Breen | 428/364 |
| 3,546,319 | 12/1970 | Prevorsek et al. | 260/857 UN |
| 3,549,741 | 12/1970 | Caison et al. | 260/857 PE |
| 3,650,884 | 3/1972 | Hansen | 161/180 |
| 3,668,274 | 6/1972 | Owens et al. | 260/857 UN |
| 3,695,992 | 10/1972 | Moulds et al. | 161/178 |
| 3,702,877 | 11/1972 | Bonafiglia et al. | 260/857 UN |
| 3,732,346 | 5/1973 | Mallonee et al. | 264/210 F |
| 3,760,054 | 9/1973 | Moulds et al. | 264/210 F |

FOREIGN PATENTS OR APPLICATIONS

| | | | |
|---|---|---|---|
| 45-5735 | 2/1970 | Japan | 264/210 |
| 41-11653 | 6/1966 | Japan | 264/210 F |
| 43-13348 | 6/1968 | Japan | 264/210 F |

OTHER PUBLICATIONS

Pyser et al., American Dyestuff Reporter, p. 864, Oct. 11, 1965.

*Primary Examiner*—J.C. Cannon
*Attorney, Agent, or Firm*—Patrick C. Baker

[57] ABSTRACT

The cold drawing of fibers spun from a melt blended mixture of nylon and certain linear thermoplastic polymers provides a soil resistant, soil hiding fiber that is particularly suitable for use in carpets.

6 Claims, No Drawings

SOIL HIDING, SOIL RESISTANT FIBER COMPRISING A RELATIVELY MAJOR AMOUNT OF A POLYAMIDE COMPONENT AND A MINOR AMOUNT OF AN ACRYLATE POLYMER COMPONENT

This applicaton is a continuation-in-part of Ser. No. 242,822 filed Apr. 10, 1972, and now abandoned.

This invention relates to a novel modified nylon fiber which is characterized by superior soil hiding and soil release properties when compared to similar products of the same base nylon.

Nylon has long been recognized as a useful fiber which is characterized by the highly desirable attribute of long wear. The fiber is exceptionally strong and abrasion resistant which particularly suits it for use in carpets. If the soil hiding, soiling resistance and soil release characteristics could be improved, the use of nylon in carpets would be significantly enhanced.

It has been found that nylon blends can be formed into fibers by standard methods and the resulting fibers cold drawn in a manner to provide a final product characterized by significantly improved soil hiding, soil resistance and soil release.

In accordance with the present invention, nylon and a suitable additive polymer are melt blended in the weight ratio of 97:3 to 70:30, and fibers are spun from the blend. Thus chips or pellets of the respective materials can be mixed in the appropriate proportions and melt extruded and spun. Those additives polymers which are useful and suitable for the present invention are those linear, thermoplastic polymers which have a glass transition temperature (Tg) substantially above that of the base nylon and which are thermally stable under the fiber forming conditions, i.e., at the temperatures encountered during melt blending, extrusion, spinning, etc. The fibers are then cold drawn to give the final product.

As employed herein the term "nylon"is intended to encompass the fiber-forming polyamides, generally, but particularly those used in carpets of which polyhexamethylene adipamide (nylon 66) and polycaprolactam (nylon 6) are the most common and preferred examples. The term ~~T~~glass transition temperature" is an indicator of polymer hardness which is described by Flory, "Principles of Polymer Chemistry," pp 56 and 57 (1953), Cornell University Press. See also "Polymer Handbook," Brandrup and Immergut, Sec. III, pp. 61–63, Interscience (1966). This property may be measured, or calculated in the manner described by Fox, Bull. Am. Physics Soc. 1,3, p. (1956). Although the glass transition temperature of the linear polymer additive is relatively independent of relative humidity, the glass transition temperature of nylon is very dependent on relative humidity. For example, bone dry nylon 6 has a Tg of about 45° C. whereas at 65% R.H. it has a Tg below room temperature.

The term "cold drawing" refers to drawing at a temperature below the glass transition temperature of the additive polymer although not necessarily below the glass transition temperature of the base nylon at the relative humidity in the drawing area (e.g. 60 to 80% R. H.). Indeed in the preferred form of the invention, the drawing temperature is intermediate the glass transition temperature is intermediate the glass transition temperature of the additive polymer and the base nylon.

The various process parameters can be varied within reasonably broad ranges provided processability of the yarn is not lost. For ease of processing, the linear polymer additives should have a glass transition temperature at least 10° C. and preferably 20° C. higher than the glass transition temperature of the base nylon at the relative humidity encountered in the drawing step, usually about 60–80% R. H. The blends containing about 30% of the additive polymer are difficult to draw but are useable for the purposes of the present invention. Those containing less than 3% fail to give the desired soil hiding characteristics. Preferably the fibers of the present invention contain from about 5–20% by weight of the additive with the most preferred compositions containing about 10%. The spun fibers are cold drawn at a high draw ratio to a residual elongation of less than 25%. In general, the draw ratio will be in the range of from about 4:1 to 5:1.

The cold drawn blend yarns of the present invention are essentially opaque. Otherwise, the general physical properties do not differ significantly from those of the corresponding hot drawn yarns. However, as might be expected, these yarns exhibit a lower elongation and higher tenacity for any particular draw ratio. A further characteristic of these yarns is a surface which is somewhat rougher than the corresponding hot drawn yarns or of the base nylon whether cold or hot drawn. The surface roughness is evident not only from scanning electronmicrographs but also from the fiber hand which in many instances is more cotton-like than is usually found in nylon materials. One of the results of the roughened surface is reduced friction when measured against the smooth surface. This can be measured quantitively by determining the tension in grams of the fiber passing over a smooth surface at the rate of 100 yards per minute. Bright nylon 6 yarns which were drawn at 130° exhibit a friction value of 25 grams when treated according to this test method. When the same yarn was drawn at room temperature, the friction measurement was 18 grams. When a nylon blend containing 20% by weight of a copolymer of about 91% by weight methyl methacrylate and 9% by weight ethyl acrylate having a Tg of about 90° C. was drawn at 75° C., it exhibited a friction of 6 grams.

In general, the additives incorporated into the yarn have a specific gravity somewhat higher than that of the base nylon. It would be expected, therefore, that the blend compositions would have a specific gravity greater than the base nylon. In fact, however, it is a characteristic of the cold drawn products of the present invention that they exhibit a specific gravity less than the corresponding base nylon which suggests the probability of void formation within the cold drawn product. Fabrics knit from the cold drawn blend yarn soil less easily and, when soiled to equal levels, appear less soiled than fabrics knit from either hot drawn blend yarn or the base nylon yarn. The opacity and soil hiding characteristics of the yarn of this invention may be explained by void formation but this does not account for the unexpected soil release characteristics.

Photomicrographs of nylon fibers drawn at various temperatures indicate that the drawing temperature controls the shape of the additive polymer fibrils, which in turn controls the scattering power or soil hiding property of the nylon fibers. The higher the drawing temperature the smaller the diameter of the additive polymer micro fibrils and the lower the scattering power and the better the soil hiding of the nylon blend fibers. Accordingly, it is preferred to cold draw the nylon additive polymer blends at ambient temperatures (substantially no heat added to the system) in order to obtain maximum scattering power and soil hiding. Typically, when no heat is put into the drawing process, the normal passage of the yarn around the draw pin causes the pin to heat up until it reaches an equilibrium temperature of about 25° to 45° C.

Suitable additive linear polymers useful in this invention include addition homopolymers and copolymers of one or more alpha, beta-ethylenically unsaturated monomers, wherein said polymer has a Tg of at least 30° C., preferably at least 75° C. Typically the addition polymer comprises at least 50% by weight of one or more hard monomers, such as methyl methacrylate, ethyl methacrylate, isopropyl methacrylate, t-butyl methacrylate, cyclohexyl acrylate, styrene, vinyl toluene, acrylonitrile, methacrylonitrile, methacrylic acid, etc. with up to 50% by weight of a soft monomer, such as methyl acrylate, ethyl acrylate, isopropyl acrylate, 2-ethylhexyl acrylate, etc. In general, the longer the alkyl chain of the soft monomer the lower the maximum concentration of this monomer in the polymer. If too much soft monomer is used, the additive polymer does not have a sufficiently high Tg for use in this invention. If desired up to 10% by weight of the additive polymer can be composed of polyethylenically unsaturated comonomers, such as divinyl benzene, butylene dimethacrylate, polyoxyethylene glycol di(meth)acrylates, etc. The preferred additive polymers have a Tg of at least 75° C. and are composed of at least 50% by weight methyl methacrylate. While the remainder of the preferred polymer can contain one or more of the above hard or soft monomers, it is usually desirable to use from 1 to 20% by weight of a soft acrylate comonomer, preferably ethyl acrylate.

In the examples which follow the invention will be illustrated with nylon 6 in either the dull form (containing about 1.9% titanium dioxide pigment), semi-dull form (containing about 0.2% titanium dioxide pigment) or bright form (containing no titanium dioxide pigment). Further, the additive, for illustration purposes, is a methyl methacrylate polymer wherein said methyl methacrylate comprises at least 50% by weight of said polymer. The invention should not be construed however as limited in this manner, but is broadly applicable to the treatment of nylons generally with various linear polymers having the characteristics specified herein and in the claims.

The soil hiding ability of a fiber and its soil retention and release properties are measured by converting the fiber to a knitted test swatch of fabric. The knitted test samples are scoured three times in a detergent and builder solution. The thoroughly rinsed and dried swatches are placed in a laboratory jar along with a number of laboratory rubber stoppers for agitation purposes and an excess quantity of carpet vacuum sweepings. This soil was obtained from a multitude of typical households, combined, obvious large scale trash removed, and heated for sterilization. The fabric/soil weight ratio is about 1:5 to 2:5. After tumbling for about 30 minutes, the excess soil is removed by vacuuming.

The soil retention property is measured by weighing a test swatch of fabric before and after soiling.

The soil hiding ability can be judged by visual examination with ranking of the swatches on the basis of their appearance of cleanliness. Preferably, the Kubelk-aMunk method is used for analyzing the soil hiding ability of yarn products. For this analysis a function, K/S, is determined for a fabric before and after soiling. K/S is calculated from the equation:

$$K/S = (1-R)^2/2R$$

where K is the light adsorption coefficient of the test medium, S is the light scattering coefficient, and R is the measured reflectance. Δ (K/S), the difference between the K/S function before and after soiling, indicates the extent of soil hiding, with the smaller value indicating a higher degree of soil hiding.

To illustrate the soil hiding ability of the yarns of the present invention a number of yarns were prepared and compared to a nylon control. In the table which follows the nylon types are abbreviated B for bright, and SD for semi-dull. The nylon was nylon 6 and the additive was a copolymer of about 91% by weight methyl methacrylate and 9% ethyl acrylate having a Tg of about 90° C. The reflectance values were measured on a single ply of knitted fabric having 28 inches per course of 70 denier/17 filament yarn as measured against a flat black background with tristimulus blue filter set at a reflectance of 74.5 for a standard tile. The results of these tests are shown in Table I.

Table I

| Fiber Composition, % Nylon/Additive | Nylon Type | Drawing Temp.* | Reflectance Initial, % | Reflectance Final, % | Δ(K-S) |
|---|---|---|---|---|---|
| 100/00 | B | 130° C. | 28.1 | 16.1 | 1.26 |
| 100/00 | B | R. T. | 30.1 | 17.6 | 1.12 |
| 100/00 | SD | 130° C. | 34.4 | 18.4 | 1.18 |
| 100/00 | SD | R. T. | 39.0 | 21.1 | 1.00 |
| 90/10 | B | 130° C. | 32.1 | 18.4 | 0.96 |
| 90/10 | B | R. T. | 46.5 | 26.6 | 0.71 |
| 90/10 | SD | 130° C. | 34.4 | 19.9 | 0.99 |
| 90/10 | SD | R. T. | 46.0 | 25.4 | 0.78 |
| 80/20 | B | 130° C. | 47.2 | 26.8 | 0.71 |
| 80/20 | B | R. T. | 50.3 | 29.1 | 0.62 |
| 80/20 | SD | 130° C. | 38.2 | 22.0 | 0.88 |
| 80/20 | SD | R. T. | 50.9 | 30.7 | 0.54 |

*"R. T." stands for room temperature

The soil retention characteristics of the products of the present invention were demonstrated, utilizing a semidull high viscosity nylon 6 blended in various proportions with a methyl methacrylate/ethyl acrylate (96/4 weight ratio) copolymer having a Tg of about 95° C. and viscosity average molecular weight ($M_v$) of about 155,000. The yarn was spun into a 46 filament 880 denier yarn and knitted fabrics made from this yarn as well as from yarns solely of the base nylon. The fabrics were soiled and the soil retention measured in the manner described previously with the soil retention of the base nylon fiber used as the standard (100%) against which the various samples were measured. In typical results a 90/10 polymer blend retained 86% of the standard and an 80/20 blend retained only 52%.

The foregoing examples generally illustrate the inventon with respect to apparel denier yarns. The advantages of the present invention are particularly of significance however in the production of carpet yarns. The nylon/polymer blends of the present invention are readily processed to form carpet yarns in accordance with normal processing treatments and have performed in the manner associated with and expected from the base nylon. Thus the yarns can be textured, tufted, dyed, knitted or woven in the manner customary in the art. Carpets produced from the yarns differ from prior nylon carpets principally only in the ability to resist soiling and to hide soil. To illustrate this aspect of the invention carpet yarn of approximately 840 denier and 46 filament was spun at a shear rate of 1683/seconds and a melt deformation ratio of about 23. The yarns so formed were cold-drawn at room temperature. By that it is meant that no heat was put into the drawing process; however, the normal passage of the yarn about the draw pin causes the draw pin to heat up until it reaches an equilibrium temperature which in the case of this example was on the order of 30° C. The yarn was then knitted on a flat bed knitter for test purposes, and 4 by 6 inch samples were subjected to soil testing. For these samples, the nylon base material was a semi-dull high viscosity nylon 6 and the polymer was a copolymer of 95.5% methyl methacrylate and 4.5% ethyl acrylate having a Tg of about 95° C. with a $\overline{M}_v$ of 155,000. The soil hiding values, after 30 minutes of soiling, are summarized in the following table for various nylon/-polymer weight ratios:

| Nylon/Polymer Ratio | Initial Reflectance | Δ(K/S) |
|---|---|---|
| 80/20 | 66.8 | 0.33 |
| 90/10 | 62.7 | 0.42 |
| 95/5 | 62.3 | 0.42 |
| 100/0 (Control) | 44.4 | 1.04 |

As is evident from the data, the higher polymer content showed the highest initial reflectance and the lowest Δ (K/S). The examination of these samples also clearly reaffirmed the much lower soil retention associated with the cold-drawn blend yarn when compared to unmodified nylon 6.

On the basis of the experimental work conducted with this development the following factors have been found to enhance soil hiding - soil release characteristics of the fiber:

1. An increase in the additive level to the maximum extent possible which is consistent with reasonable cold drawability;
2. an increase in the draw ratio;
3. a decrease in the draw temperature;
4. an increase in the viscosity of the additive.

Following the procedure of the present invention, various blends have been prepared in which the additive polymer consisted of a homopolymer of methyl methacrylate and copolymers of methyl methacrylate with methacrylic acid, ethyl acrylate, ethylthioethyl methacrylate, styrene, methyl styrene and various combinations of these, wherein said methyl methacrylate component comprised at least 50% by weight of said polymer. This, however, is not a limitaton on the invention since other linear polymers having the necessary glass transition temperature and thermal stability are equally useful and can be cold drawn to a soil hiding fiber as described herein. For example, excellent results have been obtained with copolymers of 95% by weight styrene and 5% by weight divinyl benzene.

What is claimed is:

1. An opaque, cold drawn fiber comprising a melt-blend mixture of a nylon component and a second component, said components being present in the fiber in a weight ratio of from 97:3 to 70:30, said second component consisting essentially of a polymethacrylate, an acrylate-methacrylate copolymer or a methacrylic acidmethacrylate copolymer, said second component being thermally stable under fiber forming conditions and having a glass transition temperature substantially above that of the nylon component, said fiber characterized by a specific gravity less than that of the nylon component and a soil hiding ability substantially improved over that of fibers formed from the nylon component alone.

2. The fiber of claim 1 wherein said nylon is nylon 66 or nylon 6.

3. The fiber of claim 1 wherein said second component has a glass transition temperature of at least 75° C.

4. The fiber of claim 1 wherein said second component is a predominately methyl methacrylate polymer in an amount of from about 5 to 20% by weight of the polymer blend.

5. The fiber of claim 4 wherein said nylon is nylon 6.

6. A carpet having improved resistance to soiling in which the fiber of claim 1 is the predominate pile material.

* * * * *